US009054456B2

(12) United States Patent
Orris et al.

(10) Patent No.: US 9,054,456 B2
(45) Date of Patent: Jun. 9, 2015

(54) POWER CONNECTOR ASSEMBLY HAVING AN ALIGNMENT BODY

(71) Applicant: Tyco Electronics Corporation, Berwyn, PA (US)

(72) Inventors: David Patrick Orris, Middletown, PA (US); Brandon Michael Matthews, McAlisterville, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 40 days.

(21) Appl. No.: 13/688,521

(22) Filed: Nov. 29, 2012

(65) Prior Publication Data

US 2014/0148041 A1 May 29, 2014

(51) Int. Cl.

| | |
|---|---|
| ***H01R 24/00*** | (2011.01) |
| ***H01R 13/64*** | (2006.01) |
| ***H01R 13/11*** | (2006.01) |
| *H01R 25/14* | (2006.01) |

(52) U.S. Cl.

CPC ..... *H01R 13/64* (2013.01); *H01R 13/112* (2013.01); *H01R 25/142* (2013.01)

(58) Field of Classification Search

USPC ..... 439/699.1, 746, 680, 947, 79, 80, 747

See application file for complete search history.

(56) References Cited

U.S. PATENT DOCUMENTS

| | | | | |
|---|---|---|---|---|
| 4,845,589 | A * | 7/1989 | Weidler et al. | 361/614 |
| 5,431,576 | A | 7/1995 | Matthews | |
| 5,618,187 | A | 4/1997 | Goto | |
| 2010/0203752 | A1 | 8/2010 | Urano | |
| 2012/0156909 | A1 | 6/2012 | Tyler | |

OTHER PUBLICATIONS

International Search Report issued in corresponding application No. PCT/US2013/070550 mailed on Jan. 16, 2014.

AMP; AMP PDS 125F3 Bus Plug W/ Guide of Canda Ltd.; Part No. 213647-1; Markham, Ont.;1991.

Tyco Electronics Corporation; Bus Bar Connectors Series 125; Berwyn, PA; Dec. 19, 2011.

Tyco Electronics Corporation; BusPlug; Berwyn, Part No. 213648-2; PA; Mar. 31, 2000.

Tyco Electronics Corporation; Power Connectors & Interconnection Systems; Berwyn, PA; Feb. 2010.

* cited by examiner

*Primary Examiner* — Phuongchi T Nguyen

(57) ABSTRACT

Power connector assembly including a power contact having a base portion and opposing contact springs that project from the base portion along a mating axis. The contact springs oppose each other across a receiving space and are configured to engage a common conductive component that is inserted into the receiving space in a direction along the mating axis. The power connector assembly also includes an alignment body that has a support plate and a coupling member that engages and holds the power contact. The support plate includes an elongated slot and a contact window. The coupling member holds the power contact in a designated position relative to the support plate, wherein the base portion extends into the contact window when in the designated position and the contact springs extend along and substantially parallel to the elongated slot when in the designated position.

12 Claims, 5 Drawing Sheets

POWER CONNECTOR ASSEMBLY HAVING AN ALIGNMENT BODY

BACKGROUND OF THE INVENTION

The subject matter described and/or illustrated herein relates generally to a power connector assembly.

In some electrical systems, power is delivered to a circuit board or other electrical component through a busbar and a power connector assembly. A busbar typically comprises a planar strip of conductive material (e.g., copper) having opposite sides that are configured to be engaged by the power connector assembly. Existing connector assemblies include a power contact having contact springs that oppose each other with a receiving space therebetween. Such power connector assemblies may also include an alignment body, such as an alignment plate, that has a slot configured to receive and guide the busbar. During a mating operation, the busbar is advanced between the contact springs and through the slot of the alignment plate. If the busbar is misaligned, the alignment plate may direct the busbar into a suitable orientation. The alignment plate may also protect the contact springs from being overstressed if the busbar is misaligned.

In a known power connector assembly, the power contact is positioned entirely above the plate. As such, a device that includes the power connector assembly must be configured to have enough available space to accommodate a thickness of the plate and a height of the power contact above the plate. In addition, the plate may be secured to the power contact and to a power element (e.g., power cable or circuit board) through a common fastener. For example, the plate may include a panel extension that is positioned alongside a portion of the power contact that, in turn, is positioned alongside a power element. The power contact is sandwiched between the panel extension of the alignment plate and the power element. If the panel extension cracks or is deformed, however, the force securing the power element to the power contact may be reduced, which may negatively affect transmission of electrical current through the power contact.

Accordingly, there is a need for an alternative power connector assembly having an alignment body that aligns the power contact and a conductive component.

BRIEF DESCRIPTION OF THE INVENTION

In one embodiment, a power connector assembly is provided that includes a power contact having a base portion and opposing contact springs that project from the base portion along a mating axis. The contact springs oppose each other across a receiving space and are configured to engage a common conductive component that is inserted into the receiving space in a direction along the mating axis. The power connector assembly also includes an alignment body that has a support plate and a coupling member that engages and holds the power contact. The support plate includes an elongated slot and a contact window. The coupling member holds the power contact in a designated position relative to the support plate, wherein the base portion extends into the contact window when in the designated position and the contact springs extend along and substantially parallel to the elongated slot when in the designated position such that the elongated slot receives the conductive component when the conductive component is inserted into the receiving space.

In another embodiment, a power connector assembly is provided that includes a power contact having opposing contact springs, a mounting extension, and a base portion that extends between and joins the contact springs and the mounting extension. The contact springs project from the base portion along a mating axis. The contact springs oppose each other across a receiving space and are configured to engage a common conductive component that is inserted into the receiving space in a direction along the mating axis. The base portion includes a sidewall that extends substantially parallel to the mating axis. The mounting extension is configured to engage a power element. The power connector assembly also includes an alignment body having a support plate and a coupling member that engages the sidewall of the base portion. The support plate has an elongated slot, and the coupling member holds the power contact in a designated position relative to the support plate, wherein the contact springs extend along and substantially parallel to the elongated slot when in the designated position such that the elongated slot receives the conductive component when the conductive component is inserted into the receiving space.

In yet another embodiment, a power connector assembly is provided that includes a power contact having opposing contact springs, a mounting extension, and a base portion that extends between and joins the contact springs and the mounting extension. The contact springs project from the base portion along a mating axis. The contact springs oppose each other across a receiving space and are configured to engage a common conductive component that is inserted into the receiving space in a direction along the mating axis. The base portion includes a sidewall that extends substantially parallel to the mating axis. The mounting extension is configured to engage a power element. The power connector assembly also includes an alignment body having a support plate and a coupling member that engages the sidewall of the base portion. The support plate has an elongated slot, and the coupling member holds the power contact in a designated position relative to the support plate, wherein the base portion extends into the contact window when in the designated position and the contact springs extend along and substantially parallel to the elongated slot when in the designated position such that the elongated slot receives the conductive component when the conductive component is inserted into the receiving space.

DETAILED DESCRIPTION OF THE INVENTION

Figure 1:
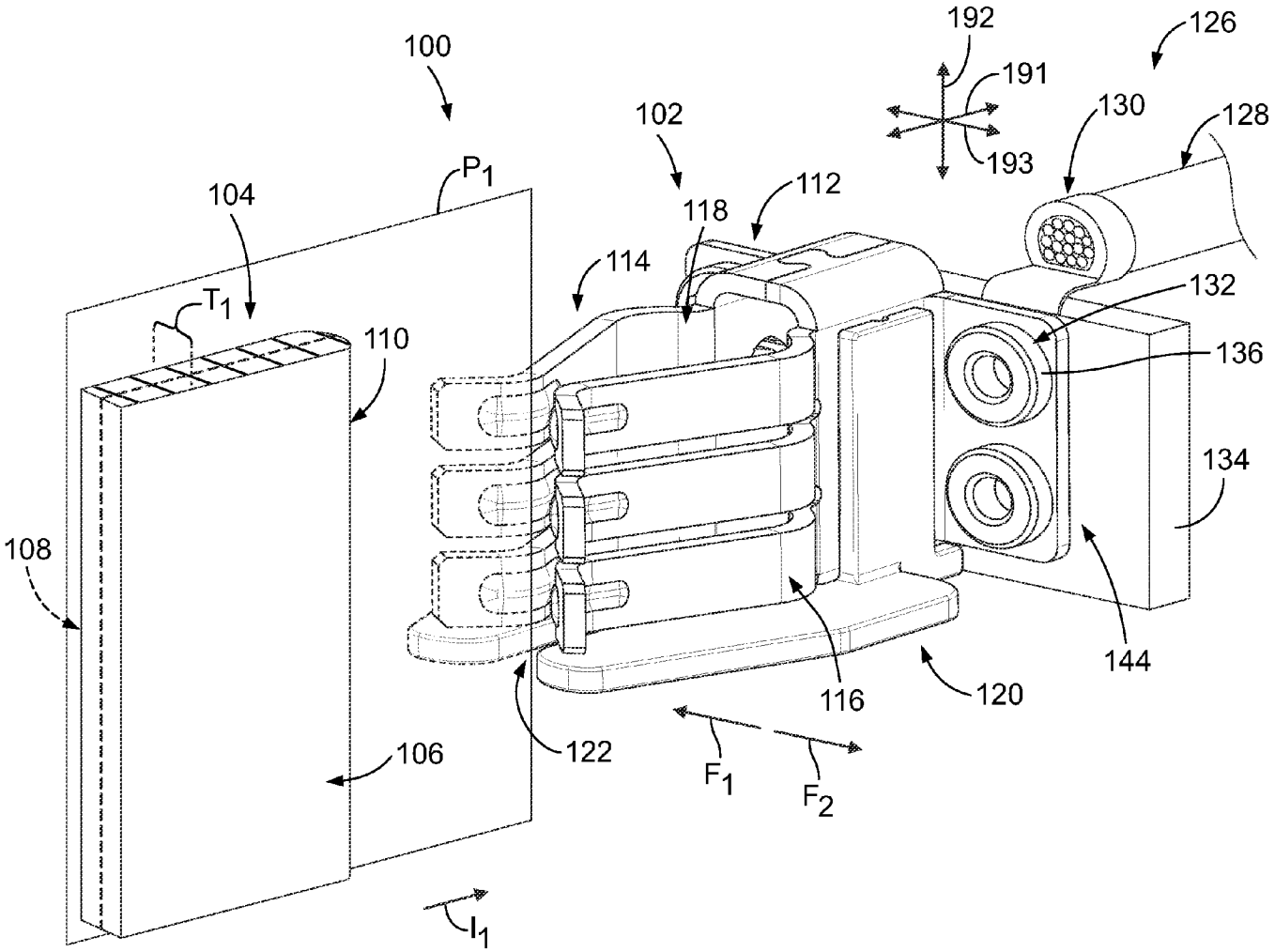
FIG. 1 is a perspective view of an electrical system that includes a power connector assembly formed in accordance with one embodiment.

FIG. 1 is a perspective view of an electrical system 100 that is formed in accordance with one embodiment. In FIG. 1, the electrical system 100 and its various components are oriented with respect to mutually perpendicular axes 191-193 that include a mating axis 191, an elevation (or vertical) axis 192, and a lateral (or horizontal) axis 193. Although in some embodiments the elevation axis 192 may extend along a gravitational force direction, embodiments described herein are not required to have any particular orientation with respect to gravity. In the illustrated embodiment, the electrical system 100 includes a power connector assembly 102 and a conductive component 104 that is configured to deliver electrical power to the power connector assembly 102 or receive electrical power from the power connector assembly 102. The conductive component 104 may be, for example, a busbar. The conductive component 104 may have a substantially planar body that includes opposite side surfaces 106, 108 and a leading edge 110. A uniform thickness $T_1$ of the conductive component 104 may extend between the side surfaces 106, 108. As shown in FIG. 1, the conductive component 104 may be oriented to extend along an insertion plane $P_1$ during a mating operation such that the side surfaces 106, 108 extend parallel to the insertion plane $P_1$. The insertion plane $P_1$ may extend parallel to the mating and elevation axes 191, 192.

The power connector assembly 102 includes a power contact 112 that has at least one contact element configured to engage the conductive component 104. For example, in the illustrated embodiment, the power contact 112 includes opposing contact springs 114, 116 that are separated by a receiving space 118. The contact springs 114, 116 may be electrically common or, in alternative embodiments, provide separate electrical pathways. The power connector assembly 102 also includes an alignment body 120. The alignment body 120 has an elongated slot 122 that is substantially coplanar with the receiving space 118. For example, the insertion plane $P_1$ may extend generally through the elongated slot 122 and the receiving space 118. In other words, the alignment body 120 and the power contact 112 are positioned relative to each other so that the conductive component 104 may be moved through the elongated slot 122 and the receiving space 118.

The power contact 112 may include a load portion 144 that is configured to be electrically coupled to a power element 126 (e.g., a power supply). For example, as shown in FIG. 1, the power element 126 may be a cable 128 having a terminal 130. The terminal 130 is illustrated as a ring terminal, although other types of terminals or methods for terminating may be used. The terminal 130 may be coupled to the load portion 144 through a fastener 132 (e.g., screw or bolt with optional nut and washer). As shown, the terminal 130 may be sandwiched between the load portion 144 and a device panel 134. Alternatively, the terminal 130 may be sandwiched between the load portion 144 and a head 136 or other feature of the fastener 132. In other embodiments, the power element 126 may be a circuit board or other component to which the power contact 112 is directly mounted. For example, the power element 126 may include the device panel 134 and the load portion 144 may directly engage the device panel 134. Accordingly, electrical current may be transmitted through the power contact 112 between the conductive component 104 and the power element 126.

During the mating operation, the leading edge 110 of the conductive component 104 is moved in an insertion direction $I_1$ along the mating axis 191 and advanced between the contact springs 114, 116 into the receiving space 118 and the elongated slot 122. The contact springs 114, 116 may engage and be deflected away from each other by the conductive component 104. The contact springs 114, 116 may slide along and be biased to press against the respective side surfaces 108, 106. During the mating operation, the conductive component 104 may engage the alignment body 120 (e.g., if the conductive component 104 is misaligned). The alignment body 120 may direct the conductive component 104 into a suitable orientation. Alternatively or in addition to orienting the conductive component 104, the alignment body 120 may operate as an anti-overstress element that reduces separation forces $F_1$ and $F_2$ experienced by the contact springs 114, 116, respectively. The separation forces $F_1$ and $F_2$ may be generally parallel to the lateral axis 193.

Figure 2:
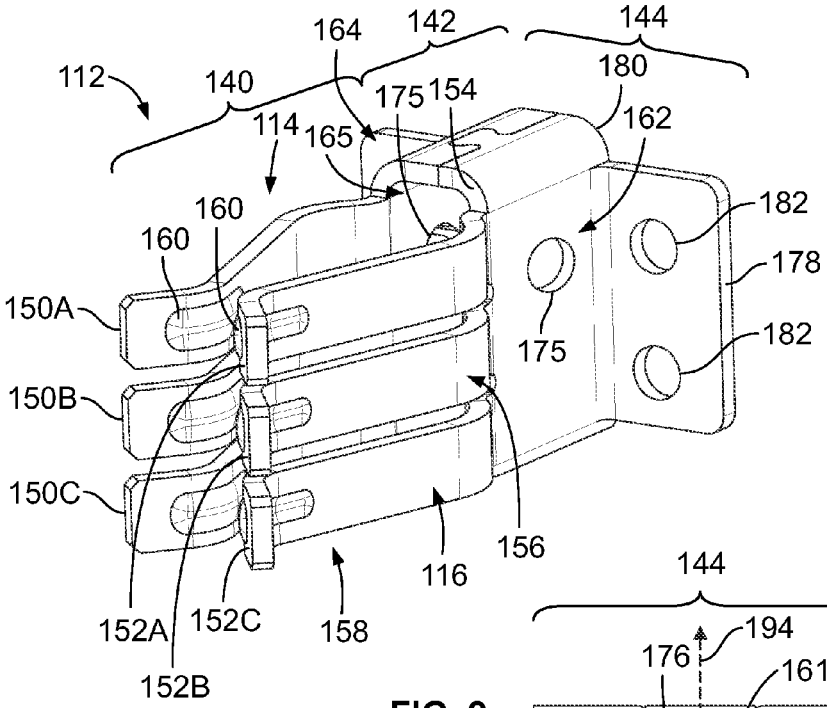
FIG. 2 is a perspective view of a power contact of the power connector assembly of FIG. 1.
Figure 3:
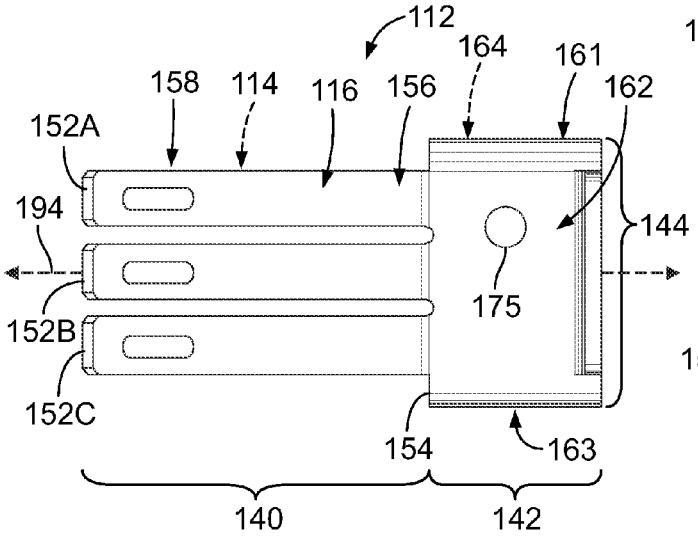
FIG. 3 is a side view of the power contact of the power connector assembly of FIG. 1.
Figure 4:
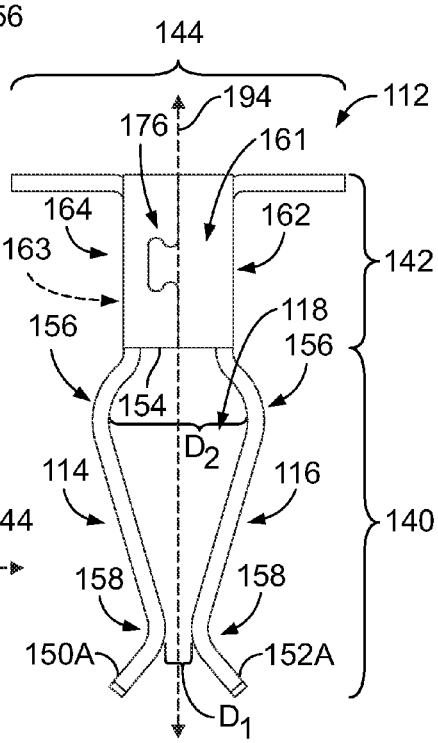
FIG. 4 is a top plan view of the power contact of the power connector assembly of FIG. 1.

FIGS. 2-4 show different isolated views of the power contact 112. FIG. 2 is a front perspective view of the power contact 112. FIG. 3 is a side view of the power contact 112, and FIG. 4 is a top plan view of the power contact 112. In the illustrated embodiment, the power contact 112 is stamped and formed from conductive sheet material (e.g., metal) to include the various structural features described herein. For instance, the power contact 112 may be formed from a single piece of stamped sheet material. Alternatively, the power contact 112 may be constructed from separate parts.

As shown in FIGS. 2-4, the power contact 112 includes an engagement portion 140, a base portion 142, and the load portion 144. Each of the engagement, base, and load portions 140, 142, 144 may be part of the same single piece of sheet material. Alternatively, one or more of the engagement, base, and load portions 140, 142, 144 may be separate and distinct from the other portions and coupled thereto to construct the power contact 112. The engagement portion 140 may be configured to mechanically engage and electrically couple to the conductive component 104 (FIG. 1) through, for example, the contact springs 114, 116. The load portion 144 is configured to electrically couple to the power element 126 (FIG. 1). The base portion 142 is located between and joins the engagement and load portions 140, 144. The base portion 142 may operate as a support for the engagement and load portions 140, 144 and provide structural integrity to the power contact 112 such that the power contact 112 is capable of withstanding repeated mating operations.

The engagement portion 140 includes the contact springs 114, 116. The contact spring 114 may include a plurality of separate contact fingers 150A-150C, and the contact spring 116 may include a plurality of separate contact fingers 152A-152C. (FIG. 3 only shows the contact fingers 152A-152C, and FIG. 4 only shows the contact fingers 150A, 152A.) Hereinafter, the contact fingers 150A-150C and 152A-152C are referred to generally as the contact fingers 150 or 152 unless specifically noted otherwise.

Each of the contact fingers 150 is capable of moving with respect to other contact fingers 150, and each of the contact fingers 152 is capable of moving with respect to other contact fingers 152. In the illustrated embodiment, the contact fingers 150, 152 are directly coupled to the base portion 142. For example, the contact fingers 150, 152 may project from a forward-facing edge 154 of the base portion 142. The contact fingers 150, 152 may project in a direction that is generally along or parallel to the mating axis 191 (FIG. 1). As shown, each of the contact fingers 150, 152 may have a corresponding base section 156 and a corresponding distal section 158. The distal sections 158 of the contact fingers 150, 152 are configured to initially engage the conductive component 104 during the mating operation.

As shown in FIGS. 3 and 4, the base portion 142 may include a portion of sheet material that is shaped to surround a central axis 194. The central axis 194 may extend parallel to the mating axis 191 (FIG. 1). The base portion 142 may include a plurality of sidewalls 161-164 that extend substantially parallel to the mating and central axes 191, 194. The sidewalls 162, 164 may be referred to as spring sidewalls 162, 164 and the sidewalls 161, 163 may be referred to as interconnecting sidewalls 161, 163 (or top and bottom sidewalls) that extend between and join the spring sidewalls 162, 164.

The contact spring 114 may extend from a portion of the forward-facing edge 154 that extends along the spring sidewall 164, and the contact spring 116 may extend from a portion of the forward-facing edge 154 that extends along the spring sidewall 162. As shown in FIG. 4, the interconnecting sidewall 161 may be defined by sheet material that is folded and attached to itself along a seam 176.

As shown in FIGS. 2 and 3, the spring sidewalls 162, 164 may each have a hole 175 that extends through the corresponding sidewall. The spring sidewalls 162, 164 may oppose each other with an aperture or gap 165 (shown in FIG. 2) therebetween. The size and shape of the aperture 165 may be determined by the dimensions of the sidewalls 161-164.

With respect to FIG. 4 only, the contact fingers 150, 152 may be shaped such that the receiving space 118 is greater between the base sections 156 than the distal sections 158. For instance, a separation distance $D_1$ may exist between the distal sections 158 and a separation distance $D_2$ may exist between the base sections 156. The separation distance $D_1$ may be less than the thickness $T_1$ (FIG. 1) of the conductive component 104 when the contact springs 114, 116 are not engaged with the conductive component 104. The shape of the contact fingers 150, 152 may enable the contact fingers 150, 152 to exert a normal force against the respective side surfaces 108, 106 (FIG. 1) to grip the conductive component 104 therebetween. More specifically, the contact springs 114, 116 (or the contact fingers 150, 152) may be predisposed or biased to provide a gripping force when the conductive component 104 is located therebetween.

In other embodiments, the contact fingers 150 of the contact spring 114 may be coupled to one another (e.g., along the distal sections 158) such that the contact spring 114 operates as a single unit. Likewise, the contact fingers 152 may be coupled to one another such that the contact spring 116 operates as a single unit. In alternative embodiments, the contact springs 114, 116 (or corresponding contact fingers) may have conductive strips (not shown) coupled thereto. In such embodiments, the contact springs 114, 116 may operate as a clamping mechanism that presses the conductive strips against the conductive component 104. The contact strips, in turn, may be electrically connected to the power element 126 through the base portion 142.

Returning specifically to FIG. 2, the contact fingers 150, 152 may include grip features 160 located along the distal sections 158. The grip features 160 may be stamped features that are shaped to project inwardly to engage the conductive component 104. In some embodiments, the grip features 160 include a coating or layer of conductive material (e.g., gold) that is configured to directly contact the conductive component 104.

Also shown in FIG. 2, the load portion 144 may include one or more members that are configured to engage the power element 126. For example, the load portion 144 includes mounting extensions or panels 178 that are configured to electrically couple to the power element 126. The mounting extensions 178 may couple to and extend from a rearward-facing edge 180 of the base portion 142. The mounting extensions 178 may include one or more openings 182. At least one the openings 182 may be configured to receive a fastener, such as the fastener 132 (FIG. 1), or other element. The fastener 132 may join the power element 126 and at least one of the mounting extensions 178.

Figure 5:
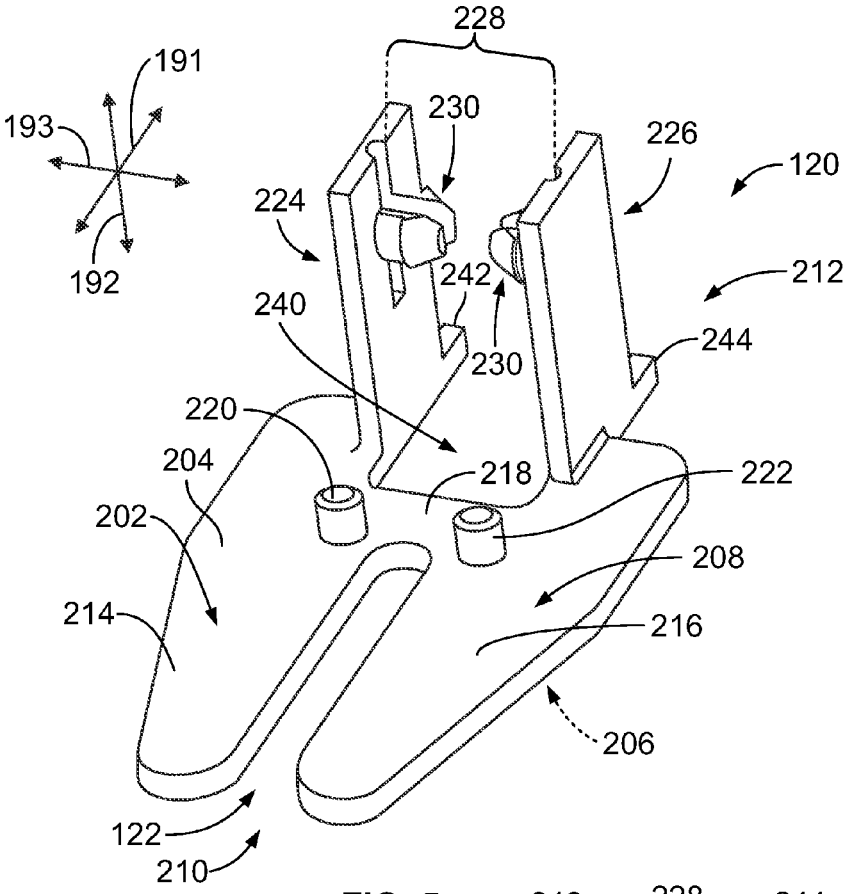
FIG. 5 is a perspective view of an alignment body of the power connector assembly of FIG. 1.
Figure 6:
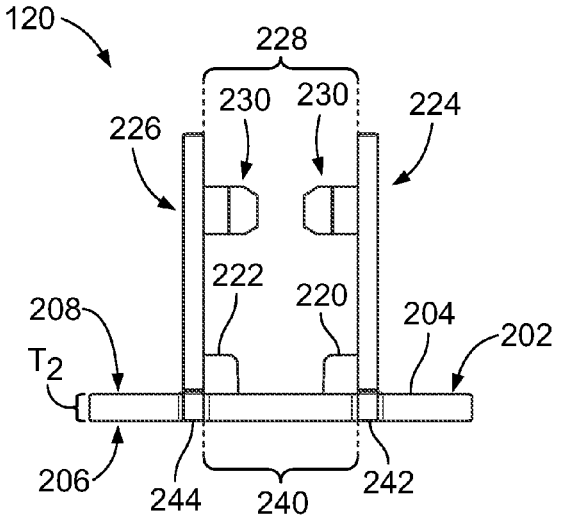
FIG. 6 is a rear view of the alignment body of the power connector assembly of FIG. 1.
Figure 7:
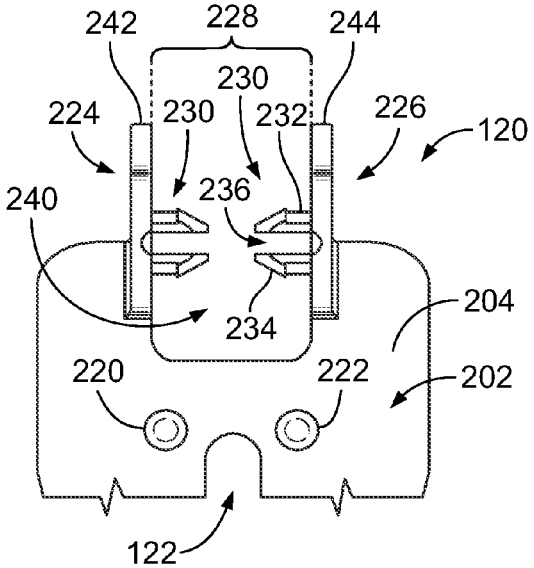
FIG. 7 is an enlarged top view of a portion of the alignment body of the power connector assembly of FIG. 1.

FIGS. 5-7 illustrate isolated views of the alignment body 120. More specifically, FIG. 5 is a perspective view of the alignment body 120, FIG. 6 is a rear view of the alignment body 120, and FIG. 7 is an enlarged top view of a portion of the alignment body 120. The alignment body 120 may include a support plate 202 that includes the elongated slot 122 (not shown in FIG. 6). The support plate 202 may comprise a substantially planar body 204 having a posterior plate surface 206 and an inner plate surface 208 that face in opposite directions. The plate surface 208 may face the power contact 112 (FIG. 1) and the plate surface 206 may face away from the power contact 112. In particular embodiments, the plate surfaces 206, 208 are substantially planar such that the support plate 202 extends along a plane defined by the mating and lateral axes 191, 193 (FIG. 5). A substantially uniform thickness $T_2$ (shown in FIG. 6) of the support plate 202 may extend between the plate surfaces 206, 208.

Also shown in FIGS. 5-7, the alignment body 120 may include one or more coupling members that are attached to and extend from the support plate 202. In the illustrated embodiment, the alignment body 120 includes first and second coupling members 224, 226 that project from the support plate 202. The coupling members 224, 226 may be elongated structures (e.g., panels or walls) that project in a direction that is substantially orthogonal to the support plate 202. For example, the coupling members 224, 226 may extend lengthwise in a direction that is parallel to the elevation axis 192 (FIG. 5).

The coupling members 224, 226 oppose each other with a contact-receiving gap 228 therebetween. Each of the coupling members 224, 226 includes a coupling projection 230 that projects toward the opposing coupling member. In particular embodiments, the coupling projections 230 extend toward each other. As shown in FIG. 7, each of the coupling projections 230 includes opposing fingers 232, 234 with a flexion gap 236 therebetween.

In particular embodiments, the power contact 112 is configured to be positioned between the coupling members 224, 226 and directly engaged by the corresponding coupling projections 230. However, in alternative embodiments, the alignment body may include only one coupling member or only one of the coupling members may engage the power contact 112. Moreover, in other embodiments, the coupling members 224, 226 may directly engage the power contact 112 without the coupling projections. For example, the coupling members 224, 226 may include holes or openings that receive projections from the power contact 112.

Also shown in FIGS. 5-7, the alignment body 120 may have a contact window 240. The contact window 240 is configured to receive a portion of the power contact 112 when the power contact 112 is held by the coupling members 224, 226. The contact window 240 may be defined between the coupling members 224, 226. As shown, the contact window 240 may extend completely through the thickness $T_2$ (FIG. 6) of the support plate 202. In particular embodiments, the contact window 240 and the elongated slot 122 are substantially co-planar. For example, a plane extending parallel to the mating and lateral axes 191, 193 may intersect each of the elongated slot 122 and the contact window 240.

With respect to FIG. 5 only, the support plate 202 includes a front end 210 and a back end 212. The elongated slot 122 extends from the front end 210 toward the back end 212. The elongated slot 122 opens toward the front end 210 and is sized and shaped to receive the conductive component 104 (FIG. 1) when the conductive component 104 is inserted along the mating axis 191. In the illustrated embodiment, the support plate 202 includes a pair of arms 214, 216 that are separated by the elongated slot 122 and are coupled to each other at a joint 218. The arms 214, 216 may narrow or taper as the arms 214, 216 extend from the joint 218 toward the front end 210. The support plate 202 may also include spring stops 220, 222 that project from the plate surface 208.

In the illustrated embodiment, the alignment body 120 consists essentially of the support plate 202 and the coupling members 224, 226. However, in alternative embodiments, the alignment body 120 may be part of a larger housing that surrounds the power contact 112. For example, the support plate 202 may be one side or wall of the larger housing, which may include additional sides coupled to the support plate 202. Also shown in FIG. 5 only, the alignment body 120 may include one or more anti-rotation posts. For example, in the illustrated embodiment, the alignment body 120 includes anti-rotation posts 242, 244 at the back end 212 that project along the mating axis 191 away from a remainder of the support plate 202. In some embodiments, the anti-rotation posts 242, 244 may define a portion of the contact window 240.

Figure 8:
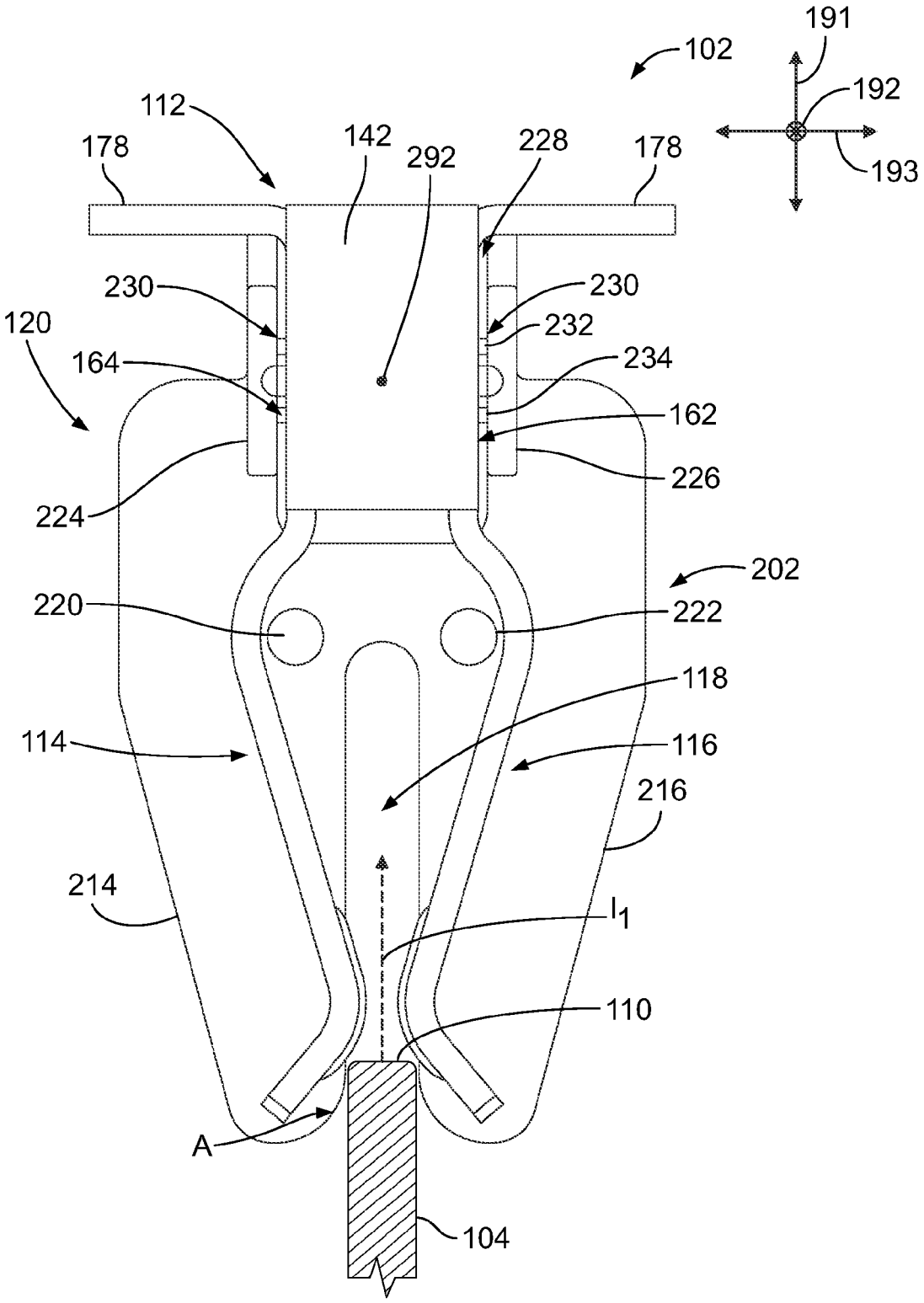
FIG. 8 is a top plan view of the power connector assembly of FIG. 1 as the power connector assembly engages a conductive component.

FIG. 8 is a top plan view of the power connector assembly 102 as the power connector assembly 102 engages the conductive component 104 during a mating operation. To assemble the power connector assembly 102, the base portion 142 may be moved along the elevation axis 192 into the contact-receiving gap 228. The coupling projections 230 may engage the spring sidewalls 162, 164 thereby deflecting the coupling members 224, 226 away from each other along the lateral axis 193. When the coupling projections 230 clear the holes 175 (FIG. 2) of the power contact 112, the coupling members 224, 226 may flex back toward each other. The fingers 232, 234 of the coupling projections 230 may be shaped to grip an interior surface (not shown) of the base portion 142.

FIG. 8 illustrates the conductive component 104 aligned with the receiving space 118. In the aligned orientation, the conductive component 104 may move in the insertion direction along the mating axis 191 into the receiving space 118 without engaging either of the aims 214, 216 of the support plate 202. As the conductive component 104 is inserted into the receiving space 118, the contact springs 114, 116 engage and are deflected away from each other by the conductive component 104. When the conductive component 104 is located within the receiving space 118, the contact springs 114, 116 grip the conductive component 104 therebetween.

During other mating operations, however, the alignment body 120 and/or the contact springs 114, 116 may not be properly aligned with the conductive component 104. For instance, the conductive component 104 may initially engage only one of the anus 214, 216. In such embodiments, the alignment body 120 and the power contact 112 may move relative to each other as the conductive component 104 is aligned by the support plate 202. By way of one example, if the leading edge 110 of the conductive component 104 engages the arm 214 at point A in FIG. 8, the coupling members 224, 226 may permit at least some clockwise rotation or other movement by the alignment body 120. More specifically, the contact-receiving gap 228 and/or the coupling members 224, 226 may permit the alignment body 120 to rotate about an axis of rotation 292 that extends parallel to the elevation axis 192. The contact-receiving gap 228 may be sized and shaped relative to the base portion 142 such that the base portion 142 is permitted to move therein. Also, at least one of the fingers 232, 234 of the coupling projections 230 may flex toward the other thereby permitting the power contact 112 to shift within the contact-receiving gap and/or rotate slightly about the axis of rotation 292. In some embodiments, the spring stops 220, 222 may engage the contact springs 114, 116, respectively, as the power contact 112 and the alignment body 120 move relative to each other. The spring stops 220, 222 may prevent the alignment body 120 from moving an excessive amount with respect to the power contact 112.

As the conductive component 104 deflects at least one of the power contact 112 and the alignment body 120, the base portion 142 and the alignment body 120 may experience stresses proximate to where the coupling members 224, 226 grip the base portion 142. In known power connector assemblies, these stresses may be located at a common connection between the power contact, the alignment body, and a mounting panel. During the lifetime of the known power connector assemblies, the alignment body may be susceptible to fracture or deformation. Accordingly, embodiments described herein are configured so that the stresses experienced by the alignment body occur at a different location (e.g., the base portion 142).

Figure 9:
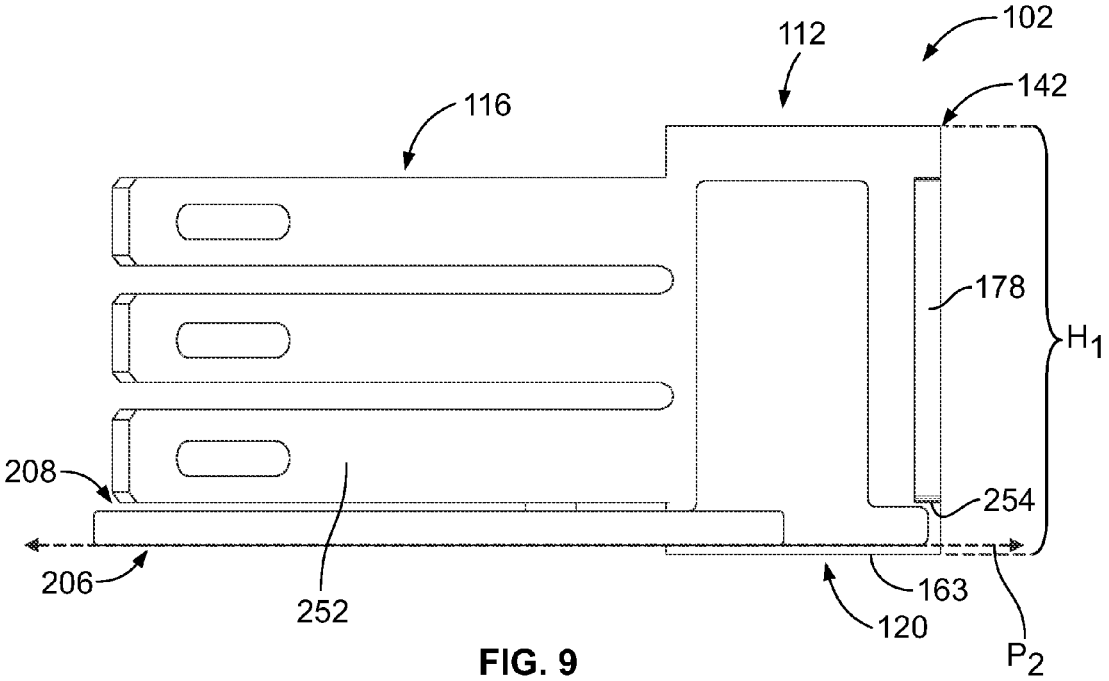
FIG. 9 illustrates a side profile of the power connector assembly of FIG. 1.
Figure 10:
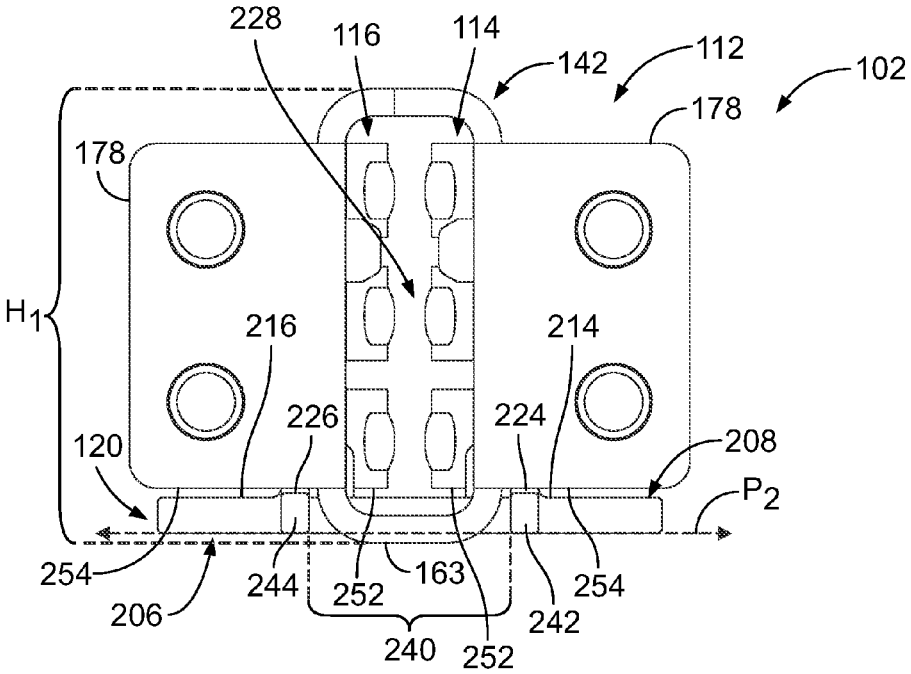
FIG. 10 is a rear view of the power connector assembly of FIG. 1.

FIG. 9 illustrates a side profile of the power connector assembly 102, and FIG. 10 shows a rear view of the power connector assembly 102. When the power connector assembly 102 is fully assembled, the base portion 142 may extend into the contact window 240 (FIG. 10). In some embodiments, the base portion 142 may extend through the contact window 240 to be substantially flush with or to clear the plate surface 206. For instance, in the illustrated embodiment, the base portion 142 clears the plate surface 206. More specifically, a surface plane $P_2$ that extends parallel to the mating and lateral axes 191, 193 (FIG. 1) may coincide with the plate surface 206 proximate to the contact window 240. The base portion 142 may extend through the contact window 240 and clear the surface plane $P_2$. As shown, an exterior of the interconnecting sidewall 163 is located beyond the plate surface 206 and the surface plane $P_2$. In such embodiments, a height $H_1$ of the power connector assembly 102 may be smaller than heights of other power connector assemblies that do not have a contact window. Moreover, the contact spring 114 (FIG. 10) and the contact spring 116 may be located closer to the inner plate surface 208.

When the power contact 112 and the alignment body 120 move relative to each other, the contact springs 114, 116 may move parallel to the support plate 202. For example, the contact springs 114, 116 may include spring edges 252 that extend parallel and adjacent to the plate surface 208. When the power contact 112 rotates or shifts within the contact-receiving space 228 (FIG. 10), the spring edges 252 may move alongside the plate surface 208. In particular embodiments, the base portion 142 may also clear the spring edges 252 as the base portion 142 extends toward the contact window 240.

Also shown in FIG. 10, the mounting extensions 178 may include base edges 254 that are positioned adjacent to the anti-rotation posts 242, 244. The anti-rotation posts 242, 244 are configured to engage the base edges 254 to prevent the alignment body 120 from rotating about an axis that extends parallel to the lateral axis 193 (FIG. 1). When the power contact 112 is secured to, for example, the power element 126 (FIG. 1), the arms 214, 216 prevent the alignment body 120 from rotating in an opposite direction about the axis. Moreover, the coupling members 224, 226 prevent the alignment body 120 from rotating about the central axis 194 (FIG. 3) of the power contact 112. Accordingly, the alignment body 120 and the power contact 112 are held in designated positions with respect to each other when the power contact 112 is in a fixed position.

In some embodiments, the alignment body 120 is exclusively supported by the power contact 112. For example, the alignment body 120 may be indirectly coupled to the power element 126 through the power contact 112 when at least one of the mounting extensions 178 is engaged to the power element 126. In particular embodiments, the power contact 112 is the only component that the alignment body 120 is directly coupled to in the electrical system 100 (FIG. 1). The power contact 112 may carry or support an entire weight of the alignment body 120.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A power connector assembly comprising:

a power contact including opposing contact springs, a mounting extension, and a base portion that extends between and joins the contact springs and the mounting extension, the contact springs projecting from the base portion along a mating axis and defining a receiving space therebetween, the contact springs configured to engage a common conductive component that is inserted into the receiving space in a direction along the mating axis, the base portion including a sidewall that extends substantially parallel to the mating axis, the mounting extension configured to engage a power element; and an alignment body comprising a support plate and a coupling member that engages the sidewall of the base portion, the support plate having an elongated slot, the coupling member holding the power contact in a designated position relative to the support plate, wherein the contact springs extend along and substantially parallel to the elongated slot when in the designated position such that the elongated slot receives the conductive component when the conductive component is inserted into the receiving space.

2. The power connector assembly of claim 1, wherein the alignment body is exclusively supported by the power contact, the alignment body being indirectly coupled to the power element through the power contact when the mounting extension is engaged to the power element.

3. The power connector assembly of claim 1, wherein the coupling member includes a coupling projection and the sidewall includes a hole therethrough that is sized and shaped to receive the coupling projection.

4. The power connector assembly of claim 1, wherein the mounting extension includes an opening and the power connector assembly is part of an electrical system that includes a fastener and the power element, the fastener extending through the opening of the mounting extension to secure the mounting extension to the power element.

5. The power connector assembly of claim 1, wherein the coupling member permits the base portion of the power contact and the support plate to move relative to each other.

6. The power connector assembly of claim 5, wherein the contact springs move parallel to the support plate when the base portion and the support plate move relative to each other.

7. The power connector assembly of claim 1, wherein the sidewall is a first sidewall and the base portion includes a second sidewall that opposes the first sidewall.

8. The power connector assembly of claim 7, wherein the coupling member is a first coupling member and the alignment body further comprises a second coupling member, the first and second coupling members engaging the first and second sidewalls, respectively, and holding the base portion therebetween.

9. A power connector assembly comprising:

a power contact including opposing contact springs, a mounting extension, and a base portion that extends between and joins the contact springs and the mounting extension, the contact springs projecting from the base portion along a mating axis and defining a receiving space therebetween, the contact springs configured to engage a common conductive component that is inserted into the receiving space in a direction along the mating axis, the base portion including a sidewall that extends substantially parallel to the mating axis, the mounting extension configured to engage a power element; and an alignment body comprising a support plate and a coupling member that engages the sidewall of the base portion, the support plate having an elongated slot and a contact window, the coupling member holding the power contact in a designated position relative to the support plate, wherein the base portion extends into the contact window when in the designated position and the contact springs extend along and substantially parallel to the elongated slot when in the designated position such that the elongated slot receives the conductive component when the conductive component is inserted into the receiving space.

10. The power connector assembly of claim 9, wherein the alignment body is exclusively supported by the power contact, the alignment body being indirectly coupled to the power element through the power contact when the mounting extension is engaged to the power element.

11. The power connector assembly of claim 9, wherein the contact springs have respective spring edges that extend parallel and adjacent to a plate surface of the support plate, the base portion clearing the spring edges as the base portion extends toward the contact window.

12. The power connector assembly of claim 9, wherein the elongated slot and the contact window are substantially coplanar.

* * * * *